US006386973B1

(12) United States Patent
Yoseloff

(10) Patent No.: US 6,386,973 B1
(45) Date of Patent: May 14, 2002

(54) CARD REVELATION SYSTEM

(75) Inventor: Mark L. Yoseloff, Henderson, NV (US)

(73) Assignee: Shuffle Master, Inc., Las Vegas, NV (US)

( * ) Notice: Subject to any disclaimer, the term of this patent is extended or adjusted under 35 U.S.C. 154(b) by 0 days.

(21) Appl. No.: 09/334,426

(22) Filed: Jun. 16, 1999

(51) Int. Cl.[7] ..... A63F 1/00
(52) U.S. Cl. ..... 463/13; 273/292; 273/274
(58) Field of Search ..... 463/12, 13, 9, 463/15, 11; 273/274, 309, 292

(56) References Cited

U.S. PATENT DOCUMENTS

| | | | | |
|---|---|---|---|---|
| 4,743,022 | A | * | 5/1988 | Wood |
| 4,813,675 | A | | 3/1989 | Greenwood |
| 4,861,041 | A | | 8/1989 | Jones et al. |
| 5,019,973 | A | * | 5/1991 | Wilcox |
| 5,033,744 | A | | 7/1991 | Bridgeman et al. |
| 5,042,818 | A | * | 8/1991 | Weingardt |
| 5,228,081 | A | | 7/1993 | Breeding |
| 5,275,411 | A | | 1/1994 | Bredding |
| 5,288,077 | A | | 2/1994 | Jones |
| 5,308,065 | A | * | 5/1994 | Bridgeman |
| 5,356,140 | A | | 10/1994 | Dabrowski et al. |
| 5,364,105 | A | | 11/1994 | Jones |
| 5,377,973 | A | | 1/1995 | Jones et al. |
| 5,437,462 | A | | 8/1995 | Breeding |
| 5,452,899 | A | | 9/1995 | Skratulia et al. |
| 5,529,309 | A | | 6/1996 | Bartlett |
| 5,531,440 | A | | 7/1996 | Dabrowski et al. |
| 5,577,731 | A | | 11/1996 | Jones |
| 5,584,485 | A | | 12/1996 | Jones et al. |
| 5,607,162 | A | | 3/1997 | Boylan et al. |
| 5,626,341 | A | | 5/1997 | Jones et al. |
| 5,660,393 | A | | 8/1997 | Dreger |
| 5,669,813 | A | | 9/1997 | Jairazbhoy et al. |
| 5,775,992 | A | | 7/1998 | Wood et al. |
| 5,794,964 | A | | 8/1998 | Jones et al. |
| 5,795,225 | A | | 8/1998 | Jones et al. |
| 5,803,809 | A | | 9/1998 | Yoseloff |
| 5,947,821 | A | * | 9/1999 | Stone |
| 6,123,335 | A | | 9/2000 | Adkins ..... 273/292 |

* cited by examiner

*Primary Examiner*—Benjamin H. Layno
*Assistant Examiner*—Vishu Mendiratta
(74) *Attorney, Agent, or Firm*—Mark A. Litman & Assoc. P.A.

(57) ABSTRACT

A method of playing a hybrid live casino and video wagering game and an apparatus for playing that game, including a game of poker comprises:

a) dealing a number of playing cards to a player(s) at a live casino gaming table to form an original hand. The player(s) has made a wager on a game such as a poker game being played with that original hand or places a wager at any time before seeing one or more cards of the hand;

b) from a separate, virtual deck of playing cards, dealing one card that is a display card, displayed on a video monitor that can be seen by the player(s);

c) at any time during play of the game, revealing on the monitor the value of the display card, the display card establishing a fact that cards of equal rank or value to the display card are Wild Cards for the purpose of establishing a rank or value (e.g., total point count) for the player's hand; and d) paying the player for attaining a hand of at least a predetermined rank with or without the presence of Wild Cards or for displaying a hand that wins against a dealer's hand in the play of an underlying game or attains a poker rank that receives a payout irrespective of its relationship to the rank of a dealer's hand. Where the game is a draw poker game, steps such as allowing the player to discard cards from the original hand, and dealing player replacement cards to bring the player's hand up to the number of cards used to play the game of poker may be used.

30 Claims, 3 Drawing Sheets

200
202
204
206
208
210
212
214
216
218
220
222
224
226
228
230
232
234
236
238
240
242
250
252
254
256
258
260

PLAYER PLACES WAGER
300
DEAL EACH PLAYER A HAND FROM FIRST MASTER SET OF CARDS
302
306
CONCLUDE PLAY
304
308
REVEAL CARDS IN HAND
SELECT/REVEAL WILD CARD FROM SECOND MASTER SET OF CARDS
COMPARE OUTCOMES TO PAY TABLE
310
AWARD PAYOUTS/ COLLECT LOSING BETS
312

300
302
304
306
308
310
310
312

CARD REVELATION SYSTEM

BACKGROUND OF THE INVENTION

1. Field of the Invention

The present invention relates to methods and apparatus that may be used with games of chance and skill, specifically to card games which are particularly suitable for use in casinos or private clubs and which can be played either as a hybrid live casino/video game, computer-based internet game, video or virtual table game, or video game. In particular, the invention relates to an apparatus and method that may be used with a card game in which a wild card or a community card is provided in the play of the game.

2. Background of the Art

Wagering games played in casino establishments have achieved a very high level of public acceptance. Particularly in the United States, there are now thousands of casinos in many different locations, and in certain jurisdictions, private businesses may have video gaming equipment. The rise in gaming has been in large part because of the entertainment value of gaming, the variety of games available to provide interest to the player beyond the gaming aspects of play itself, and greater acceptance of gaming by the public. It is generally recognized that successful games should: (1) be entertaining for the players, (2) attract the attention of and visual interest of players, (3) stimulate rapid numbers of wagers during predetermined time periods; (4) provide reasonable and understandable odds to the player; (5) provide unvarying overall odds in favor of the casino; (6) be sufficiently simple to allow rapid acceptance of the game with a short learning curve, and (7) be easily monitored by observers and any dealer to avoid errors and cheating. Both casino table games and video games have achieved high levels of success with these parameters kept in mind during their design.

There are a wide variety of card games, particularly poker games available to players in private games, club games, casino table games and on video gaming equipment. In casino video gaming equipment, the easiest format to work with comprises variants of five-card draw poker. This game is played in a video gaming format with many variations, for example, by having five cards dealt to a player. The player selects his best cards (e.g., the cards most likely to provide a highly ranked hand when the player discards and draws replacement cards), discards unneeded cards, and then draws replacement cards. The objective in these video games is generally to achieve the best possible hand, according to conventional poker hand rankings, with hands of various ranks being awarded payouts that are multiples (usually with limits from about 1:1 to about 4000:1) of the wager. The game has such a readily appreciated ease of understanding and play that the format has been highly successful. Common variants of this game include games where deuces within the playing deck are wild, jokers added to the playing deck are wild, multiple mixed decks are used for the dealing of hands, extra bonuses are provided for unique hands, and the like. These variations in the rules are still readily understood and add variety to the basic pure game of five card draw.

U.S. Pat. No. 4,743,022 to Michael Wood, 1988, discloses a poker game which can be played on a computer video output screen gaming machine or as a table game. At the start of the game, the player makes a first wager and receives five cards, which constitutes a first hand. As is known to those skilled in the art, five-card poker hands are ranked, for competitive purposes, according to the following order from lowest to highest: (1) High Card in Hand; (2) One Pair; (3) Two Pair; (4) Three of a Kind; (5) Straight; (6) Flush; (7) Full House; (8) Four of a Kind; (9) Straight Flush; (10) Royal Flush; (11) Five of a Kind (which is possible only if a joker is used). Then each player may discard up to five cards and receive five new cards to form a second hand. The player loses the first wager if the second hand (or the first hand when no cards are discarded) does not have a pair. The player receives the wager back if the hand has a pair. The player receives a payout which exceeds the first wager in accordance with the posted odds if the hand is of higher order than a pair. The player is also entitled to make a second wager and to receive a sixth card. A five-card third hand having the highest possible ranking is then formed by combining the newly dealt card and any four of the five cards in the second hand. If the third hand is ranked lower than a straight and is of lower order than the second hand, the player loses the second wager. However, if the third hand has a ranking of a straight or greater and is of higher order than the second hand, the player wins an amount which depends on the second wager and the posted odds.

Although the Wood's game allows the player an additional possibility of winning by providing the sixth card, the payout odds must be diminished proportionally, thus decreasing the generated level of excitement. Moreover, the thrill of the game is also reduced because the sixth card rarely produces a dramatic improvement in the ranking of the player's hand. Furthermore, the rules of the game are fairly complex, involving three different hands and sometimes enigmatic criteria for receiving the sixth card (the video-game version). Several wild-card versions of Wood's game have been suitable for casinos. In these, a wild card may possess any value specified by the player. For example, when deuces are wild, they can be counted as kings, aces, or have any other value and can fill in straights or flushes. Other variations of the game exist, for instance with jokers or eights wild. However, when wild cards are used, the game lacks the exciting element of surprise since the wild cards are declared to the player at the start of the game. Moreover, the game is rendered less attractive because the player always retains the wild cards and hence a lower pay table must be utilized. Thus, the player normally wins only when his or her hand ranking is three of a kind or higher.

U.S. Pat. No. 5,308,065 describes a poker game comprising a player making a wager and then being dealt a hand of five cards in a specific card location, with the cards being viewed by the player (e.g., face-up). The player is also dealt a single card from the same deck, this card being dealt face-down. The player may attempt to improve the five card hand by utilizing standard five card draw steps. After the player has acted on the five card hand, the sixth card is turned face-up, and all the cards in the player's hand which have the same face value as the turned card are designated as a wild card.

The method of playing the game of chance in U.S. Pat. No. 5,308,065 is described as utilizing a maximum set with a finite plurality of scorable units, each having a fixed value, wherein the scorable units can be assembled, according to predetermined rules, into small sets having different rankings, said method comprising the steps of:

a player placing a wager; the player receiving an original set of A scorable units randomly chosen from the finite plurality of scorable units, where A is an integer, the original set having a ranking known to the player, thereby reducing the maximum set by the number of scorable units in said original sets. The player receives a solitary scorable unit randomly chosen from the finite plurality of scorable units remaining, the solitary scorable unit having a value concealed from the player, thereby reducing the maximum set by one additional unit. The player has a chance to improve the ranking of the original set by discarding up to A scorable units from the original set and replacing them with an equal number of scorable units randomly chosen from the remaining finite plurality of scorable units, thus forming a modified original set. The value of the solitary scorable unit is revealed to said player. All scorable units of the modified original set which have the same value as the solitary scorable unit are assigned replacement arbitrary values which maximally improve the ranking of the modified original set. The modified original set is evaluated in accordance with predefined criteria to determine whether the player has won or lost the wager. Thus the play of the game provides a wild card from within the set of symbols used in the play of the game.

U.S. Pat. No. 5,042,818 describes a multideck poker game that is able to provide unique hands without the use of wild cards. A first hand is dealt from a first deck of cards. The player may select an additional card or cards to be dealt into his playing hand from an additional deck of cards. The player may discard cards , with replacement cards coming from the original decks from which the discards were dealt. In this manner, a hand of six or more cards may be created that has the possibility of poker hands unavailable from a single deck (e.g., a seven card royal flush).

U.S. Pat. No. 5,356,140 describes a video format gaming apparatus where a player makes a wager to participate in the game and the player is dealt two distinct hands at the beginning of the game. Each hand is dealt from its own separate complete deck of cards. The player selects one of the hands to play and the unselected hand is voided or removed from use. The player plays out the selected hand according to the conventional manner of play of the hand.

U.S. Pat. No. 5,803,809 describes a method of playing a card game wherein multiple decks of playing cards are used in a unique format which results in hands being possible that were not previously available. In the play of the game, such as five card draw poker, each card position in a player's hand is dealt from a distinct deck. This enables the possibility of unique hands such as five aces of spades, without the need for using wild cards. In addition to the use of standard decks of cards, this method contemplates the use of decks which have been modified slightly, such as by the addition of two jokers to each deck. Similarly, U.S. Pat. No. 5,775,992 enables the possibility of unique types of hands by shuffling, for example, the same number of decks together as there are cards in a player's hand (e.g., five decks would be shuffled together where the game is five card stud). This allows similar types of hands as U.S. Pat. No. 5,803,809.

U.S. Pat. No. 5,019,973 describes a method of playing poker in which after a primary game (e.g., five card stud) is played on a video gaming machine, a second wager may be placed to enter into an additional game. In this additional game, another card is dealt from the same deck of cards, and this another card is compared to the cards in the original and final hand. If the another card matches the value of one or more cards in the original final hand, all of the matched cards are changed in value to a wild card, and the hand is re-evaluated for the purpose of determining awards. The second wager is made on an additional poker game, based upon the cards used in the original poker game.

U.S. Pat. No. 5,275,411 describes an automatic card shuffling machine including a dealing module and a display module. The machine has a microprocessor and a deck-receiving shuffling station into which a deck of cards is deposited initially. A carriage mechanism separates the deck into two deck portions, rotates the two portions to a relative angular relationship with a corner of each in close proximity, riffles the portions, and combines them into a single shuffled deck. A shuffled deck delivery system delivers the shuffled deck to the dealing module which moves a predetermined number of cards, one at a time, into a hand holding shoe. The display module displays game information to players. The machine is particularly well-suited for playing pai gow poker.

Games have been played throughout history in which symbols are assigned to players, with symbols of particular rank or relationship determining relative value or strength of a player's position within play of the game. Such games include games of chance including the use of instrumentalities such as dice, tiles, cards, spinning wheels and reels (as in slot machines). The advent of computers and associated monitors and their use within the gaming industry has provided essentially unlimited potential for the expansion of games into different instrumentalities as well as providing the older, traditional instrumentalities in a different format. For example, many of the games of chance played with physical instrumentalities are now played in video format, such games including Mah Jong, blackjack, craps, virtual reel slots, dominoes, poker, and games invented specifically for play on video screens.

Many versions of video draw poker have been around for years. Essentially, all electronic versions are played as follows, with minor variations: Five cards are dealt face-up to the player, the cards typically being randomly drawn from a single deck of fifty-two cards. The player selects which cards he or she likes, and discards the rest. To help in executing this selection, there are five "hold/cancel" buttons, one associated with each card position. The player selects a card to keep by pressing the hold/cancel button. If for some reason the player wants to change the card selection, he or she presses the hold/cancel button again. The player selects from zero cards to a maximum of five cards to be replaced in a five card originally dealt hand. The word "hold" is written on the video screen adjacent to (usually above) each selected card. The player discards the cards not indicated as on "hold" by pressing a draw or draw/deal button. New randomly selected cards from the residue of the fifty-two card deck are used to replace the discarded cards. After the player discards, certain final hands result in awards of money or credits. Posted pay tables determine the amount of player wins.

Manufacturers and casinos actively look for new and better versions of games such as video draw poker to maintain the interest of existing players and to introduce new players to exciting variations of the basic game. Some changes that have been tried include at least the following. Jokers and wild cards have been added to the card deck to enable higher hit frequencies for larger value hands to stimulate play. Some versions of video poker allow players to play double-or-nothing with all or a portion of awards after a winning hand. A "Second Chance" game, from Bally Manufacturing, allows the player to make another bet after the original round of card play has concluded. The player obtains one additional (sixth) card with a second chance to win.

Live house banked poker games, also termed pit poker games have encountered a significant revitalization at casinos. Part of the revival is the introduction of varieties of stud and draw poker games and progressive jackpots. Progressive jackpots are represented in the general casino gaming literature in U.S. Pat. Nos. 4,861,041; 5,377,973; 5,584,485; and 5,626,341 and specifically to games of Twenty-One in U.S. Pat. Nos. 5,288,077; 5,364,105; and 5,577,731. The underlying theme in the progressive jackpot games is that separate bets are initially made in an underlying game and a side wager on the appearance in the wagering player's hand of a predetermined arrangement of cards. U.S. Pat. Nos. 5,794,964 and 5,795,225 describes a method and apparatus for including a jackpot component as an additional feature in a live casino game.

U.S. Pat. No. 5,033,744 describes a new poker game, specifically a poker game with a draw or card replacement step, in a video game where a specific card is "zapped" or eliminated and a replacement provided, even if it is the intent of the player to zap or replace more than a single card. Rather than committing all cards to replacement, a decision may be made on each card in the sequence of zap and replace. This may provide the player with an option of changing strategies as each replacement card is dealt.

To increase the excitement and entertainment of the player and to offer games to the player, side bet games have been developed, both for live gaming and for video gaming. In some situations, awards for the side bet games may be independent of the rank of the dealt hand in the primary game. A common feature in some poker games is the addition of a progressive jackpot, as described in U.S. Pat. Nos. 4,861,041; 5,377,973; 5,584,485; and 5,626,341 and specifically to games of Twenty-One in U.S. Pat. Nos. 5,288,077; 5,364,105; and 5,577,731. These patents generally show that a progressive, and possibly much higher value jackpot, may be won by a player by making a separate and independent wager at the beginning of the primary game (before cards are dealt). This separate wager is won if predetermined arrangements of cards, such as certain poker hands of rated value (usually at least three-of-a-kind, straight, flush, full house, four-of-a-kind, straight flush and royal flush), are achieved in the play of the hand. The highest progressive jackpot value is usually won when the player obtains a royal flush, either with the cards in a specific order (e.g., A K Q J 10, also referred to as a "positional win") or in a random order (e.g., with the cards A K Q J 10 appearing in any arrangement or order). With the separate bet being placed, the jackpot or special award for the player achieving a rated (higher value) hand is paid in addition to awards won in the play of the primary game. This separate wager, however, is still won only when the player exhibits a hand with a relatively high poker value. A predetermined arrangement of cards which is independent of play in the underlying game could be, for example, a rank of a poker hand achieved in the play of a hand of Twenty-One, four aces in a Twenty-One game, or a Twenty-One point count total achieved in a poker hand. An example of a predetermined arrangement of cards which is dependent upon play of the underlying game could be, for example, specific ranks of poker hands (e.g., four-of-a-kind or straight flush) achieved during play of an underlying poker game.

U.S. Pat. No. 5,660,393 describes a method of playing a card-based wagering game. An underlying card game with wagering is played, and a side bet game is also played. The side bet game is played by the player making an independent wager (a card wager as opposed to a game wager) on a range of possible cards, a particular card of any suit, any card of a particular suit, a particular card of a particular suit or any combination of the above. In the preferred embodiment, the wager is made on the appearance of a card within three separate ranges of value (e.g., cards of six and lower, cards of value 7, 8 and 9, and cards of value ten or higher. The card wager appears to be required prior to the beginning of any of the games.

U.S. Pat. No. 5,529,309 describes a card game, similar to baccarat, in which a side bet is also allowed. The side bet is based upon a wager that the dealer's hand and the player's hand will have the same, non-zero value at the end of play. The wager is described as being made before play of the hands has begun, that is, prior to the deal.

U.S. Pat. No. 5,607,162 describes a method of playing a matching card game. Hands are dealt by randomly generated distributions of cards to players and to a dealer. More than one deck must be used in play, with an individual deck for the dealer or with multiple decks, the reasons becoming apparent with the play of the game. The dealer turns up his cards in sequence, and the players turn cards face down when the cards match. The player wins a wager if all of the player's cards are turned face down, and the house wins the wager if any of the cards remain face up. Poker hands above a specific value (e.g., above three-of-a-kind) are also awarded. The wager is made prior to the deal or exposure of cards in the hands. A single ante bet is placed at the beginning of the game.

U.S. Pat. No. 5,452,899 describes a method of playing a wagering game in which players select sets of winning numbers. Players place wagers, the dealer provides two cards face-up to the players, and then compares the value of the two cards with the selected sets of winning numbers, the dealer awarding a prize to the player whose winning numbers include the numeric sum of the face-up cards. If the two face-up cards are equal to two predetermined key cards, the dealer and players may implement a bonus playing procedure.

U.S. Pat. No. 5,531,440 describes a "Double Poker" game in which a player is initially dealt two distinct poker hands after an initial wager. The play of the hand may include the player selecting only one of the poker hands to be played. The game may also include an additional game in which, where there is a first and second hand, the player is awarded a predetermined amount if one or more cards from the first hand (e.g., a five card stud hand) match one or more cards from the second hand (either in number, number and suit, and/or position). The matching of cards may also be associated with a progressive payout or progressive jackpot, particularly in a video gaming machine. The play of the game is based upon the initial wager in the primary game, and the wager must be made before both of the hands are dealt.

U.S. Pat. No. 4,813,675 describes a casino table system that is convertible from a casino table game (such as blackjack or poker) into a video playable system. A removable top formatted as a live play blackjack or poker game is removable, revealing monitors in each of the player positions that may be used to play various video format casino games. The two games, the live action game and the video game, are not described as interactive.

These games provide a useful variety of games to be played in various casino or private formats, but there is always a desire for different games with unique playing features to be available. Additionally, it is desirable for methods and apparatus to be provided that facilitate the playing of the games. Particularly with the advent of video screens (e.g., cathode ray tubes (CRT) screens, light emitting diode (LED) screens, liquid crystal (LC) screens or other image providing systems) and computer processing units (CPU), games have been enabled for much greater flexibility and efficiency. Gaming apparatus are provided for many different types of games that were originally played only in a live version, and many unique features have been added to the play of those games, particularly with respect to the graphics and animation that can now be provided. For example, poker games, either stud or draw, with or without wild cards, can be played on video gaming apparatus. Blackjack is played in a single video format, and the graphics that are now provided can include such detail as the hands of the dealer distributing cards, movement of chips during bets, stacking of chips that have been won, and other features that are both entertaining and simulating of a live table game. Other blackjack video systems replicate a live table, with no live dealer being present, but all cards and other features being effected by a computer and video screens. The video screens are provided in each of the player positions and separately in the dealer position, just as if cards were being physically dealt to those positions.

BRIEF DESCRIPTION OF THE INVENTION

A method of playing a game, including a game of poker, the method comprising:

a) dealing a number of playing cards from a first deck of cards to a player to form an original hand. The player has made or subsequently makes a wager on a game such as a poker game being played with that original hand or places a wager at any time before or after seeing one or more cards of the hand;

b) from a separate deck of playing cards, dealing one card that is a display card;

c) showing the value of the display card, the display card establishing a fact that cards of equal rank or value to the display card are Wild Cards for the purpose of establishing a rank or value (e.g., total point count) for the player's hand; and d) paying the player for attaining a hand of at least a predetermined rank with or without the presence of Wild Cards or for displaying a hand that wins against a dealer's hand in the play of an underlying game;

wherein the separate deck of cards comprises at least one virtual separate deck and the card is displayed on an image screen (e.g., preferably in a space between a dealer and at least one player).

The game is therefore preferably played as a combination live table game with a video display and software/computer game component. This provides a unique level of comfort to players of the game in that the physical cards and the virtual cards are not related, neither the dealer nor the computer deals both sets of cards, and the game provides a perception of less control by the house (e.g., whether a live dealer or computer).

Where the game is a draw poker game, steps such as allowing the player to discard cards from the original hand, and dealing player replacement cards to bring the player's hand up to the number of cards used to play the game of poker may be used.

DETAILED DESCRIPTION OF THE INVENTION

Figure 1:
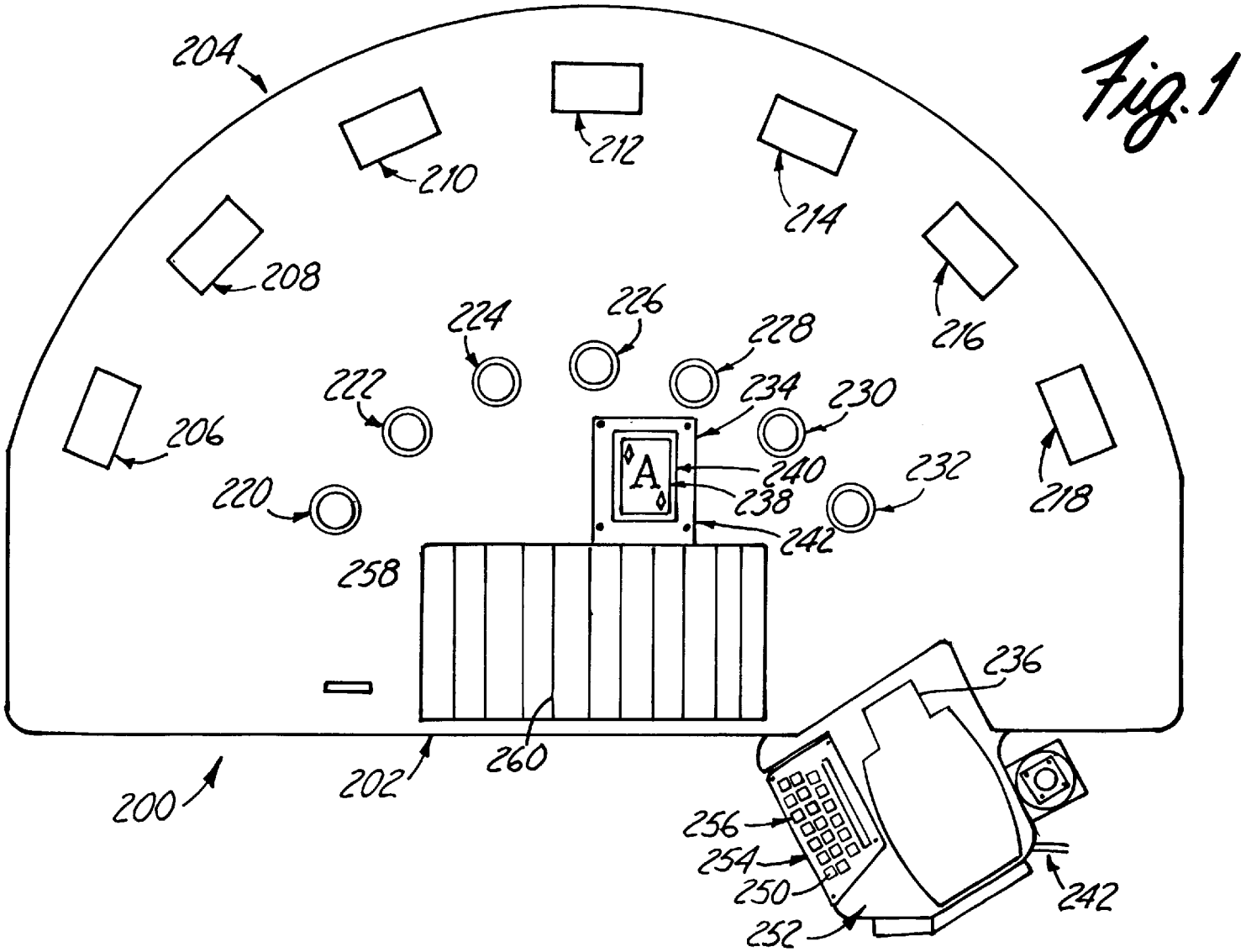
FIG. 1 is an overhead view of a playing area of a card table with a single video display according to the invention.

One aspect of the present invention is a unique method of playing a hybrid live casino table/video supported game as a casino-type card game that combines a) a live action table game and b) a video or computer component to the game. The term "live action game" refers to the fact that there is a human acting as a dealer in the game, along with human player(s). The game itself may be any format of cards or symbol play with real cards and real symbol objects (e.g., tiles, reels, wheel, dice or the like) and a second, independent set of virtual cards or virtual symbol objects that are used in the play of the game, that preferably are not directly incorporated into a player's hand. There are a number of particularly unique concepts even in this single embodiment of the invention. First, both real cards or real symbol objects are used in the live action segment of the game with an independent set of virtual cards and/or virtual symbol objects. Secondly, the virtual cards or virtual symbol objects are randomly selected from an independent set of cards (e.g., a separate deck or decks) or and independent set of real symbol objects (e.g., tiles or die or dice). Thirdly, the randomly selected cards or symbol objects are not actually incorporated into a player(s) hand. Rather, in a preferred embodiment the randomly selected symbols or cards indicate a special value of related cards, for example, designating them as a wild card, or indicating suits or pairs with special awards.

As a first example of the present invention, for a non-limiting example only, includes a hand of cards dealt to a player by a dealer from a first master set of actual playing cards. If the underlying game is conventional draw poker or stud poker, the player receives the number of cards appropriate for that game, e.g., two, three, four, five, six or seven cards from a single 52 card deck, which are available for viewing by the player. For other games, such as Blackjack, the master set may include up to six or more decks of cards, and the number of cards dealt to each player may vary. According to an example of a preferred game to be played with the apparatus and method of the present invention, at least a single card is dealt from a second and separate virtual deck to be available to a single player or to all of the players. This single card is preferably determinative or indicative of cards in the player(s) hand(s) that will become wild cards in the play of the game. Where the game uses dice or symbols, the video display will show a randomly generated die value or symbol randomly generated from dice or other symbol generators that are not used by the player(s). Either before, during, after or at the conclusion of play of the underlying game, the single card is revealed in response to the dealer activating the device. Before revelation of the actual face of the card, an image of the back of the card may be displayed on the monitor. The rank, suit, or rank and suit of the revealed card determines which card(s) in the player's hand are wild. Cards held by the player having a rank, suit, or rank and suit equal to that of the revealed card become wild cards.

The method can be practiced by dealing each player his or her own wild card, or by dealing a common or "community" wild card to multiple players participating in a round of play. Preferably, the wild card is a community card and does not become part of the player's hand. It preferably serves as an indicator of which cards in the master set of cards are considered wild during that hand.

The method and apparatus of the present invention are practiced on an apparatus that combines a live action game (live dealer and at least one and more live players) with a video output display device (e.g., associated with a Single Board Computer [hereinafter, "SBC"], and program, as later explained). The live gaming table will include a visual display device (e.g., CRT, LED, LCD or any other visible display monitor that can provide an image sent in digital or analog form from a memory or data generator). For security purposes and the convenience of the players and dealer, the display device preferably should be on the surface of the table, in the physical space between the dealer and the player(s). This space is usually near where the dealer's hand or common cards (if any) are displayed and in front of the positions of the players' hands(s). Although the following disclosure describes the method of the present invention in the context of draw poker, the method can be used to enhance the excitement and entertainment value of nearly any casino card game, such as 5 card stud poker, Blackjack, Pai Gow poker, Let it Ride® Stud Poker, Caribbean Stud® poker, Baccarat, mini Baccarat, and variations of draw poker, including Texas Hold 'Em, Deuces Wild, and Triple Play Poker® as well as symbol oriented games such as Mah Jong, dice betting, and the like.

One format for play of a hybrid gaming table/video augmented casino game may comprise a system as illustrated in FIG. 1. A gaming table 200 is preferably a standard gaming table equipped with electronic bet detection equipment. The gaming table 200 is shown with a dealer's side 202 and a player's side 204. Seven players' positions 206, 208, 210, 212, 214, 216 and 218 are shown on the player's side 204 of the gaming table 200. Seven bet sensors 220, 222, 224, 226, 228, 230 and 232 are shown associated with players' positions 206, 208, 210, 212, 214, 216 and 218, respectively. The players' real cards are dealt by a dealer to each of the players' positions 206, 208, 210, 212, 214, 216 and 218. A keypad 254 is provided that permits the dealer to input game information. The keypad 254 is in communication with the game CPU (not shown). A single monitor 234 is shown generally disposed towards the dealer's side 202 of the gaming table 200. The monitor may be disposed in other positions, such as more towards the players positions 206, 208, 210, 212, 214, 216 and 218, but is shown in the illustrated location for exemplary purposes only. Alternatively, additional monitors may be provided. For example, if each player received a separate wild card, it would be desirable to provide a monitor at each player station. Cards (not shown) for an underlying game are dealt to each of the players' positions 206, 208, 210, 212, 214, 216 and 218. These cards may be hand dealt by a dealer, from a deck of cards hand shuffled or mechanically shuffled, as by the Shuffle Master® shuffler 236, such as the shuffler shown in commonly assigned U.S. Pat. No. 5,275,411 or handed out by the dealer from hands that were automatically shuffled and individually dealt and allocated to a player by the Shuffle Master® shuffler 236. At some time during the game, the dealer preferably activates a random number generator or random virtual deck selection program in the SBC (not shown) by activating a button on the keypad controls 254. The random number generator or program randomly selects a number corresponding to a card from a virtual deck. The corresponding virtual card is then displayed. The virtual card may be initially displayed on the monitor 234 either face up or face down according to the program selected. As elsewhere discussed herein, the card may be revealed to the player at a time in the game selected by the program or rules for the game, the time being selected to accommodate the rules of the game and/or the development of strategies in the game and/or adjust the returns to the player and/or the house. The virtual card 238 (shown as the Ace of diamonds) is shown on the screen 240. The step of revealing a displayed card can also be accomplished by depressing or otherwise activating a button on the keypad controls 254. The screen 240 lies within a frame 242. The frame 242 may be designed so that it lays flat in a plane with the surface 242 of the gaming table 200. A bezel (an exterior supporting frame, not shown) may also be used to form an edge around the frame 242 of the monitor 234. Both a bezel and the use of a frame 242 lying flat with the surface of the gaming table 200 assist in preventing any events caused by cards inadvertently striking an edge or surface during play. The even surface does not provide a readily available structure on which a card could catch, and a bezel masks part of the frame 242 and provides such a significant feature that a dealer will naturally and intentionally tend to avoid striking the bezel feature with a card.

The SBC (not shown) typically is located beneath the surface of the gaming table and includes an optional cable 242 to a game CPU or central computer (not shown). It is often desirable for security purposes or necessary according to local laws, to have all computer driven or computer supported games report to a computer and have the information about each game (e.g., the number of players, the number of bets, the number of side bets, the number of hands, the number, frequency and size of payouts, the number of bonuses, etc.) reported and charted. For example, each game (irrespective of the number of players) may be assigned a unique number or alphanumeric for reporting purposes. This number, and all recordable events during the play of that unique hand are reported and recorded (and possibly analyzed in combination with other games) by the central computer.

The key pad 254 (which may alternatively be a keyboard) is used to issue commands to the SBC by way of an activation button 250, typically located on the key pad 254. The activation button 250 also could be located on the table or in proximity to the table. The various keys 256 on the key pad 254 may provide specific commands for the play of the game, for communication with the shuffler 250, for communicating with the CPU, for identifying the number and positions of players, for identifying hands of special ranks, special awards, altering pay tables, clearing sensors 220, 222, 224, 226, 228, 230 and 232, locking the sensors 220, 222, 224, 226, 228, 230 and 232, signaling the CPU 250 of the status of the underlying game, commanding that the virtual card 238, if initially displayed on the monitor 240 face down, be converted to a face-up position, for generating reports or performing any other tasks associated with the play of the underlying game.

The monitor 240 displays the virtual card 238 in any format desired, as the image is computer controlled or computer generated. It is particularly desirable if the image of the virtual card 238 on the monitor 240 does not exactly reproduce the appearance of the real cards being used in the play of the game. This optional use of an image of a virtual card 238 that is different from the appearance of the real cards may provide both a security function and an entertainment function. For example, if the virtual card 238 image exactly matched the image of the real cards, it would be possible to place a real card over the monitor to provide a specifically advantageous effect to a particular hand. The use of a virtual card 238 with an image significantly different from the images on the real cards would reduce or eliminate this security risk. The use of a virtual card 238 with an animated, i.e., moving image, would completely eliminate that security risk, as it would be impossible to place a physical or real card with a moving image over the monitor.

Figure 2:
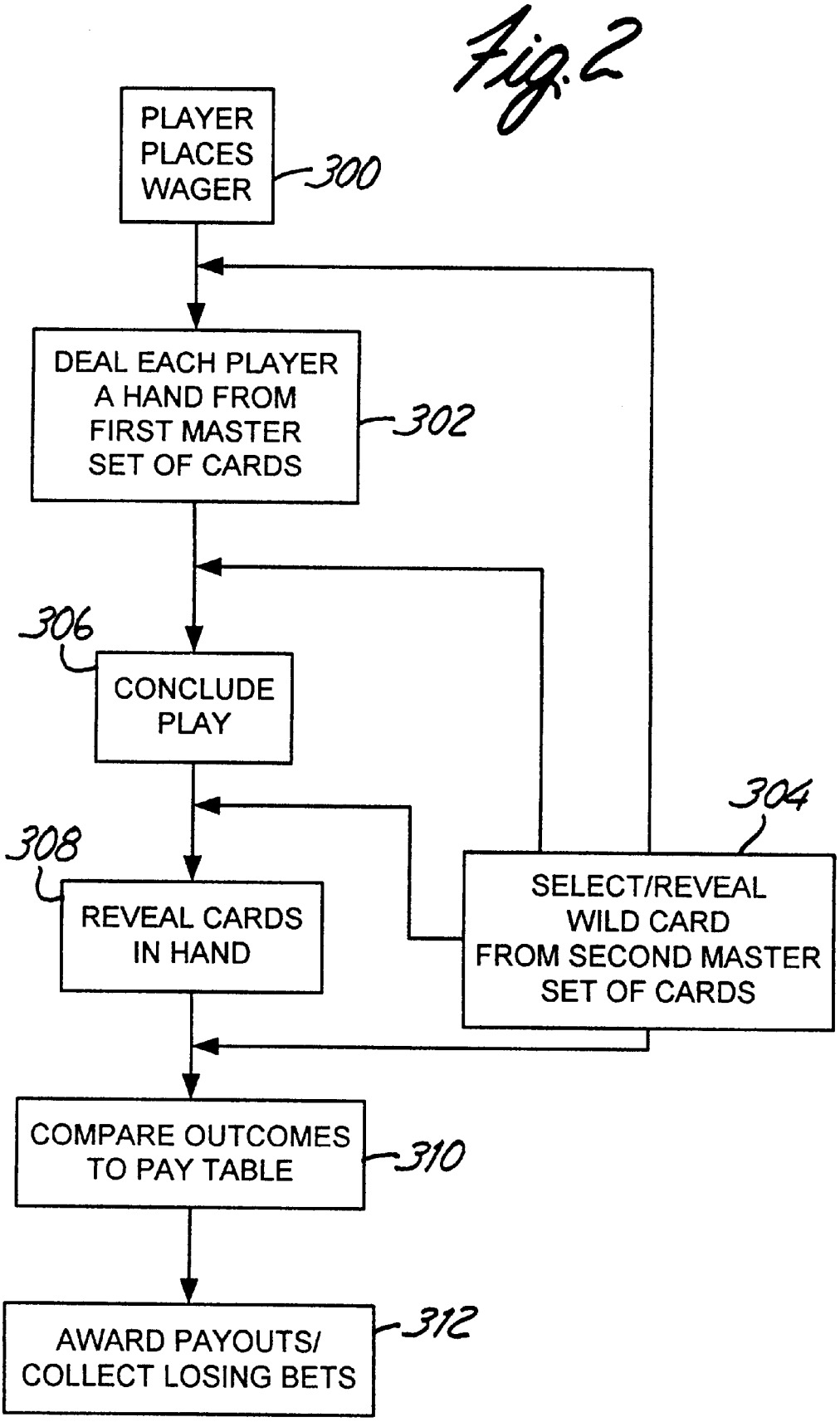
FIG. 2 is a flow chart which illustrates a sequence of logical operations performed by the central processing unit of the video card-game apparatus of FIG. 1 for draw poker with a randomly-determined wild card from a separate deck.

The coin, token or chip sensors 220, 222, 224, 226, 228, 230 and 232 are shown in FIG. 2 as proximity detectors, in which the placement of the coins over the detectors is registered on the computer and the proximity detectors 220, 222, 224, 226, 228, 230 and 232 provide a visible signal that a coin or token (not shown) has been placed thereon. For example, each of the proximity detectors 220, 222, 224, 226, 228, 230 and 232 that has a token placed on it to initiate a bet will light up in response to sensing the presence of the token. Coin or token acceptors (not shown) alternatively may be used. A coin acceptor is understood in the art to mean a device that actually physically receives and accepts a token or coin, as through a slot, with the acceptor automatically registering the placement and acceptance of a token or coin. For example, as the token or coin passes into a slot, a detector detects its presence and signals the game CPU (e.g., 250). When the token or coin actually drops into a collection area (not shown) for bets, the acceptance or passing of the coin is registered in the game CPU (e.g., 250). The operation of a token, coin or bet acceptor is therefore distinctly different and an alternative process and apparatus to the use of a proximity detector 220, 222, 224, 226, 228, 230 and 232 that recognizes only the placement of the bet, but does not accept the bet. That physical function of physically removing and collecting wagers placed on a proximity detector must be performed by the dealer with the use of a proximity detector.

The monitor 242 may also be used to display pay tables before, during or after conclusion of a game. For example, after a wild card has been determined, the screen 240 may alternatively display the wild card (e.g., the Ace of Diamonds) and a pay table. That pay table may be general (i.e., the pay table is inclusive of any and every card being shown as the wild card) or may be specific for differing wild cards (e.g., the pay table would be different for at least certain cards being randomly chosen and then revealed for other cards). For example, varietal games and varietal pay tables my be created where different pay tables are provided for different wild cards. A different pay table could exist for each value or rank of card, or only one or more pay tables could exist depending upon the random selection of particular cards as the wild cards. For example, an especially higher level of payout could be provided when tens were wild, as with a ten percent increase in all payouts for higher ranked hands. For example, if the payout for four-of-a-kind with at least one wild card was 100× the original wager, when the four-of-a-kind was achieved with tens being wild, the pay table may describe a payout of 110× the original wager, 90× the original wager, or some other value that has been predetermined for the particular game.

The area 258 denoted in FIG. 1 could represent the dealer's card receiving area or a larger monitor could be provided in this location for display of pay tables (not shown). Area 260 represents a chip tray.

In a first embodiment of a particular game that might be played on the described system, a hybrid live casino game/video gaming device could operate as follows. The SBC (not shown) is programmed to display at least one card or symbol that is related to an underlying live casino game, with a preferred example being a stud poker game. The apparatus may perform in the following manner. A player places a wager to participate in the game. A dealer provides each of the players with the requisite number of cards to be dealt to a player in the game (e.g., usually at least two, more usually at least three, four or at least five cards). The SBC (not shown) either itself or from another random generating source, transmits image data to the monitor of a randomly selected card. The image may display the entire identification of a card (e.g., rank and suit) or at least one characteristic of a card (e.g., rank, value [inclusive of all cards having a value of ten; as face cards and tens in blackjack], color or suit). The card or its characteristic(s) revealed in the monitor then act to determine what cards in the real deck that have been used in the live casino table game constitute a wild card. For example, the rules of the game may determine that with the selection of the Ace of Diamonds, only the Ace of Diamonds is wild (therefore requiring only a modest alteration of the pay table or no alteration from conventional pay tables for the underlying game). For example, where in such games as Let It Ride® stud poker or Caribbean Stud® poker, the bonus or jackpot for a Royal Flush or straight flush may not have to be altered (providing a higher frequency of awarding the large bonus) or may be modestly adjusted, such as reducing the bonus for a Royal Flush achieved with a wild card to 10% of the normal bonus achieved without a wild card. Similar alterations may be done with other payouts, or the payouts may remain the same, adding an increased chance for the player to attain a large bonus award. The game may also be played where the revelation of the Ace of Diamonds means that all Aces in a player's hand become wild cards. The pay tables would almost assuredly have to be adjusted with the addition of four wild cards to the game, at least with the pay tables adjusted for ranked hands achieved with the use of wild cards. The game may also be played where the revelation of the Ace of Diamonds means that all diamonds in the player's hand are wild cards. Again, the pay tables would have to be adjusted with the addition of such a significant number of wild cards to the play of the game. The virtual deck from which the wild card is randomly selected may comprise a standard 52 card deck, a fifty-two card deck with jokers (the selection of a joker enabling the player to select any value card in a player's hand as a wild card), a truncated deck (e.g., a pinochle deck, so that only cards of values above eights could be wild; or decks with only 2's through 7's, or only odd value cards such as Aces, 3's, 5's, 7's and 9's, or the like) or any other collection of cards from which a random selection may be made. The apparatus for enabling the video aspects of the wagering game may comprise or include, at least for example, a casino table, CPU, SBC, dealer controls, a wager acceptor, electrical and electronic connection to a central computer, key pads, key boards, token or wager sensors, token or wager acceptors, pay table displays, audio speakers, software programs to effect special activities or game enhancement (e.g., to provide music or sounds when hands of special rank are achieved, generate a visual or light display when hands of special rank are achieved) and a video monitor attached to the console.

The SBC contains memory capable of generating a display of a single or multiple object image for use in the play of the live casino aspects of the game comprising:

displaying a randomly selected card(s);

then revealing the card at some time related to the event of placing of a first wager for entering the underlying game or a bonus game;

dealing cards to the player(s) at least after the player(s) have placed a wager;

the random selection of the card(s) comprising the random selection of at least one card from a virtual deck or collection of cards, the at least one card being randomly selected from an independent virtual deck of cards at a time either before, during or after some event in the play of the underlying live casino wagering game. The at least one card must come from a virtual deck of cards, whether a standard, special or variant deck, that is a distinct virtual deck from the deck or decks used in the provision of the player's cards;

revealing said at least one card(s) at a time before, during or after a game outcome is revealed or displayed;

displaying a game outcome (which may include only the display of all players' cards, all the players' cards and the dealer's cards, the display of all the players' cards and all community cards);

establishing a rank (e.g., a poker ranked hand) or comparative value (e.g., counting value of cards as in blackjack, baccarat, 7½ or 21½, or other value counting games) for the player's hand, using any wild cards present in the player's hand (if there are no wild cards present in the player's hand, normal valuation will occur). Where value of hands is being determined, wild card values may be restricted. If wild cards were given unlimited values in Blackjack, for example, every hand with a wild card would be a Twenty-One. The limits could include specific values such as 1, 2 or 3; 3, 4 or 5; or only tens and the face value, for example); and awarding the player a payout for attaining a hand of at least a predetermined rank (e.g., a pair, two pairs, three-of-a-kind, straight, flush, etc.) or at least a value better than a dealer's hand, the award being made whether or not a wild card is present in the player's hand.

A side bet component to the game may also be provided as part of the hybrid casino table/video enhanced wagering game of the invention. In one embodiment of a side bet game, the player places an optional wager that his hand will be a predetermined rank that pays according to a pay table, or qualifies the player to receive all or part of a progressive payout. The side bet component of the game may require a player to attain a poker ranked hand of at least a minimum predetermined threshold value in combination with a primary or underlying game. A distinctly novel characteristic of the side bet game is that the side bet may be made at any time before, during or after play of the underlying game, including before assignment of symbols or deal of the cards (the term cards will be used although the game is understood to include other symbols), after the deal of any of the cards, after the deal of all of the cards, before the resolution of the underlying game, and after resolution of the underlying game. The side bet game may even be entered after both sets of cards (the underlying play cards and the wild card determinator) are dealt, as long as both sets are not completely exposed. This includes the extremes of the situations where a) all cards may be dealt to the player (and/or the dealer), but neither completely or partially revealed, b) the wild card is selected and either displayed or not displayed and the player(s)' hand has been dealt and either not revealed, partially revealed or completely revealed, and c) a player's hand is exposed completely, and the wild card(s) has not been completely exposed. One additional unique attribute of the game is that such a wager may be made after a portion or all the player's cards have been viewed and may be placed contemporaneously with a wager on the underlying game or after the underlying wager has been placed and play of the underlying game has begun. This side bet game is particularly compatible with poker games, either stud poker games, Pai Gow poker or draw poker games.

The side bet could qualify the player to win payouts for predetermined arrangements of cards, for a part of a progressive payout or for the application of the wild card to the player's hand in scoring the round of play. If no side bet is offered, keypad 254 is needed, and the SBC can be operated by a button (not shown) mounted on or in close proximity to the table.

The electronic circuit of the gaming apparatus includes a game CPU (Central Processing Unit) which may be connected to a clock circuit, memory, an interface circuit, a video-display circuit, a coin-hopper circuit, and/or a data-storage circuit. The memory may be composed of a Read-And-Write Memory (RAM) and a Read-Only-Memory (ROM). The ROM may include or comprise a disk, chip, hardware or other software element. The RAM stores the game's variables and may have a battery back up. Thus, when the video apparatus of the present invention is disconnected from its main power supply, the data stored in RAM is preserved for approximately ten years.

The SBC controls the random selection of cards and the video display 242. The SBC may include ROM that comprises hard disk, solid state disk, or solid state chip. The SBC includes ROM that may contain information such as image patterns (memory bit maps) for the playing cards or symbols as well as the operating instructions. An interface circuit could incorporate a sound generator and key activators, usually connected to the key pad or key board accessed by the dealer or casino employee. Alternatively, the activator can be separate from the keypad. A light circuit may be designed to illuminate those key activators ready to accept input data, which light circuit would be controlled by a drive circuit. Since the SBC may be a single-task processor, a buffer, which stores activator-key input information, may be placed before an input/output port of the SBC. A drive circuit is often provided on the game, which drive circuit is electronically linked to a sound generator, which signals to acknowledge activation of buttons or an occurrence of a win.

The video-display circuit might include the screen (e.g., a cathode ray tube or liquid crystal display) having a video circuit, electronically connected to a controller. As the controller reads out an image pattern (memory bit map) for a playing card from ROM to RAM, it converts this data to a serial data format and may send it to a video circuit. Based on the video signals generated by circuitry, a predetermined image appears on the screen.

A data-storage circuit may comprise a disk drive, connected to an input-output port of the game CPU through a buffer. A disk drive may be controlled by the drive circuit and stores such statistics as number of rounds played, winnings amounts, percentage of hold in favor of the casino, and other game information. A management key (not shown) may be used by authorized personnel to display the aforementioned data or to obtain printouts through hard-copy devices (also not shown). Other hardware and parts of the above described card-game apparatus are similar to those used in existing live casino table games or video poker machines.

FIG. 2 shows a flow chart which illustrates the sequence of logical operations performed by a SBC in the play of a five card draw-type poker game enhanced by the incorporation of a randomly selected wild card of the present invention. The implementation of the game feature with other poker-type games, such as Let-It-Ride (Registered Trademark of Shuffle Master gaming, Inc.) or Caribbean Stud® poker or the like is contemplated. The description below refers to the major steps of the flow chart, cited parenthetically. To start the game, the player wagers 300 the proper number of coins or tokens (this may be done by placing the coins or token or chips onto the playing surface in a designated area or placing them on a sensor or in a detector). The player(s) may each receive an initial player's hand 302 of, for example, the five cards initially dealt in five-card-draw poker, which cards normally would appear face up in player-hand area. The cards dealt are randomly selected from a first master set of cards, preferably consisting of a single 52 card deck of cards, or from a number of intermixed decks. At some point in the play of the game, either before the player's hand is displayed, simultaneously as the player's hand is displayed, after the player's hand is displayed, before cards are discarded, after cards are discarded and before drawing replacement cards, or after cards are discarded and after replacement cards are drawn, one or more cards appear (either face down or face up in the wild-card monitor display area 304). The usually single card is randomly selected from a second and separate deck of cards. The SBC randomly generates the wild card(s) from a first master set or "pool" comprising a single standard deck, single modified or specialty deck or even multiple decks. A deck usually corresponds to a deck of 52 standard playing cards, which is usually ranked from low to high in the order of 2, 3, 4, 5, 6, 7, 8, 9, 10, Jack, Queen, King, and Ace. Preferably, the hand is dealt from a single 52 card deck of cards.

Following the rules of draw poker, the player may attempt to improve the ranking of the five-card hand by discarding up to five cards and replacing them with new cards (i.e., a modified hand) dealt to the player from the same master set used in the play of the underlying game or otherwise conclude play 306. The player identifies the cards he or she wants to retain by any activation or identification means, including moving the cards out of the players' card retention area and towards the dealer or into a players' discard area. The discarded cards are replaced by the dealer with the same number of new cards.

The game may also be played with what is known in the art as a progressive jackpot. It is often desirable to provide a visual display panel for display of a progressive jackpot. The status of the progressive jackpot may be displayed on one or more of the monitors for use in displaying the wild card, on a separate monitor for displaying the progressive jackpot status, and/or on the monitor used to display the pay table. The visual display segment for the progressive jackpot increments additions to the jackpot from wagers made into the play of the game or decrements with payouts from the progressive jackpot when matches with a level of correspondence occur in the play of the progressive jackpot game. If the level of correspondence of a player's hand is sufficiently high, the payout for that level of correspondence would decrease the total amount of award available in the progressive jackpot, with the lower amount then being shown on the panel within the progressive jackpot display frames. The progressive jackpot is likely to be decremented for all hands above at least a certain level of payout, such as card hands which have a level of correspondence of matching at least three of five symbols displayed. Although the video display that reveals the wild card 304 is preferably built into or lain on the surface of the gaming table, the revealed virtual card can be displayed on a sign or as part of a progressive meter display.

At some point in the play of the game, here shown for exemplary purposes as simultaneously dealt with the last replacement card in draw poker, when the last card available to the player in the construction of the player(s)' hand is provided, the dealer may activate the revelation system for the wild card indicator 304. The key pad button, for example as a means of activating the revelation system, may be pressed in draw poker, for example, when the last card is displayed in stud poker, or at the end of the game in any type of poker, the single wild card indicator located on the monitor area and displayed face up. The face value, rank or face value and rank of the card displayed, determines the wild card or cards in this round of the game. Preferably all cards in the five-card hand (fewer or more cards) which have the same face value (or other characteristics, as defined earlier herein) as the card displayed are designated wild, i.e., they may possess any specified value). Each player's hand is revealed 308. Outcomes are preferably compared to a pay table to determine if there is a win 310. The rules of the game may require the player to determine or call the value of his hand, or the dealer may assist the player in determining the highest value for a hand, enabling what is termed in the art as the cards calling themselves. This becomes more important with wild card games where the wild cards may be used in different manners to construct different hands, as is well understood by those of ordinary skill in the art. A CPU program may even be established wherein the dealer enters the cards in the players' hands and the program defines or confirms the rank asserted by the player or the dealer to be the highest possible ranking hand or the hand with the highest payout for the player's cards and the wild card. Again it is to be noted that the card displayed on the monitor as the wild card designator is not actually included in the player's five-card-hand for determining a ranking; that is, it does actually not become a part of the hand. However, since it is generated from a distinct deck (e.g., of standard playing cards), a number of advantages are present which were not possible when the wild card is drawn from the master set of cards used in the underlying game. Although the deck used to draw the wild card may be a standard 52-card deck, it may be a special deck such as a Spanish Twenty-One deck. Last payouts are awarded 312 for winning hands, and losing bets are collected.

There are a number of advantages that may be found in the play of this game.

Advantage #1: The game allows for a single card to be designated as special.

When a single card is selected as the designator for all wild cards in a specific game, a pay table can designate that randomly specified card as special. This is only possible when the designator card is selected from an external deck. If the card were selected from the deck in play, there would be no feasible way to specify that card as wild without removing it from play.

The use of a single deck for play and random selection of a wild card reduces the likelihood of cards in play (e.g., kings, where two kings are held by players) becoming the wild cards.

Advantage #2: The method allows for the wild card selection without affecting the base game.

Assume there is a five-card stud game, which includes a side game. In this side game, the player may make a separate wager that pays according to the number of cards in his stud hand that match the suit and/or rank of an externally selected wild card. If the wild card is selected from an external deck, the base game will not be affected by the wild card selection for the side game.

This example illustrates that the method of the present invention need not be practiced as an underlying game. Wild cards can be used to resolve a base game, one or more side games, or combinations of the above.

Advantage #3: The method allows for differentiation in hit frequency based upon the selected wild card.

If, in a game, the selected wild card is of a low value, such as a 2 or 3, that game has a higher expected value than if the selected wild card is of a high value.

| | Ways | p(x) |
|---|---|---|
| Example A: King is Wild | | |
| Royal Flush (no wilds) | 4 | 0.00000015 |
| Wild Royal Flush | 276 | 0.0001062 |
| TOTAL | 280 | 0.000010774 |
| Example B: Two is Wild | | |
| Royal Flush (no wilds) | 4 | 0.0000015 |
| Wild Royal Flush | 500 | 0.0001924 |
| TOTAL | 504 | 0.00019392 |

The player's winnings are determined on the basis of the final five-card-hand ranking and jackpot amounts may be calculated according to any pay table or pay schedule, for example a pay schedule such as the following:

| Hand Rank | Bonus Payment |
|---|---|
| Royal Flush (without wild cards) | 500 × BET |
| Five of a Kind | 250 × BET |
| Royal Flush (with wild cards) | 200 × BET |
| Straight Flush | 25 × BET |
| Four of a Kind | 5 × BET |
| Full House | 4 × BET |
| Flush | 4 × BET |
| Straight | 3 × BET |
| Three of a Kind | 2 × BET |
| Two Pair | 2 × BET |
| One Pair (Jacks or Better) | 1 × BET |

Since the payouts will vary depending upon the rank and/or suit of the wild card selected, it would be advantageous to provide an electronic display of the pay table which reveals payouts for the particular wild card selected. For example, the payout for a Royal Flush formed with a King that is wild pays more than a Royal Flush formed with a 2 that is wild, based on the probability of occurrence of the hands. Advantageously, a changeable display could display the pay table which corresponds to the selected wild card and could conceal payouts for wild cards which are not in play. This feature is likely to simplify the process of paying bonuses and is also likely to eliminate player or dealer confusion as to the payouts.

The card game is attractive to players because the wild cards make it possible to win large jackpots on small wagers and hands with high ranks may be more frequently attained. Moreover, since the wild cards are preferably declared only after the player has a chance to alter his or her hand, an exciting element of surprise is introduced into the game. Also, the pay schedule may be fixed throughout the game and no additional wagers are required during the round.

Figure 3:
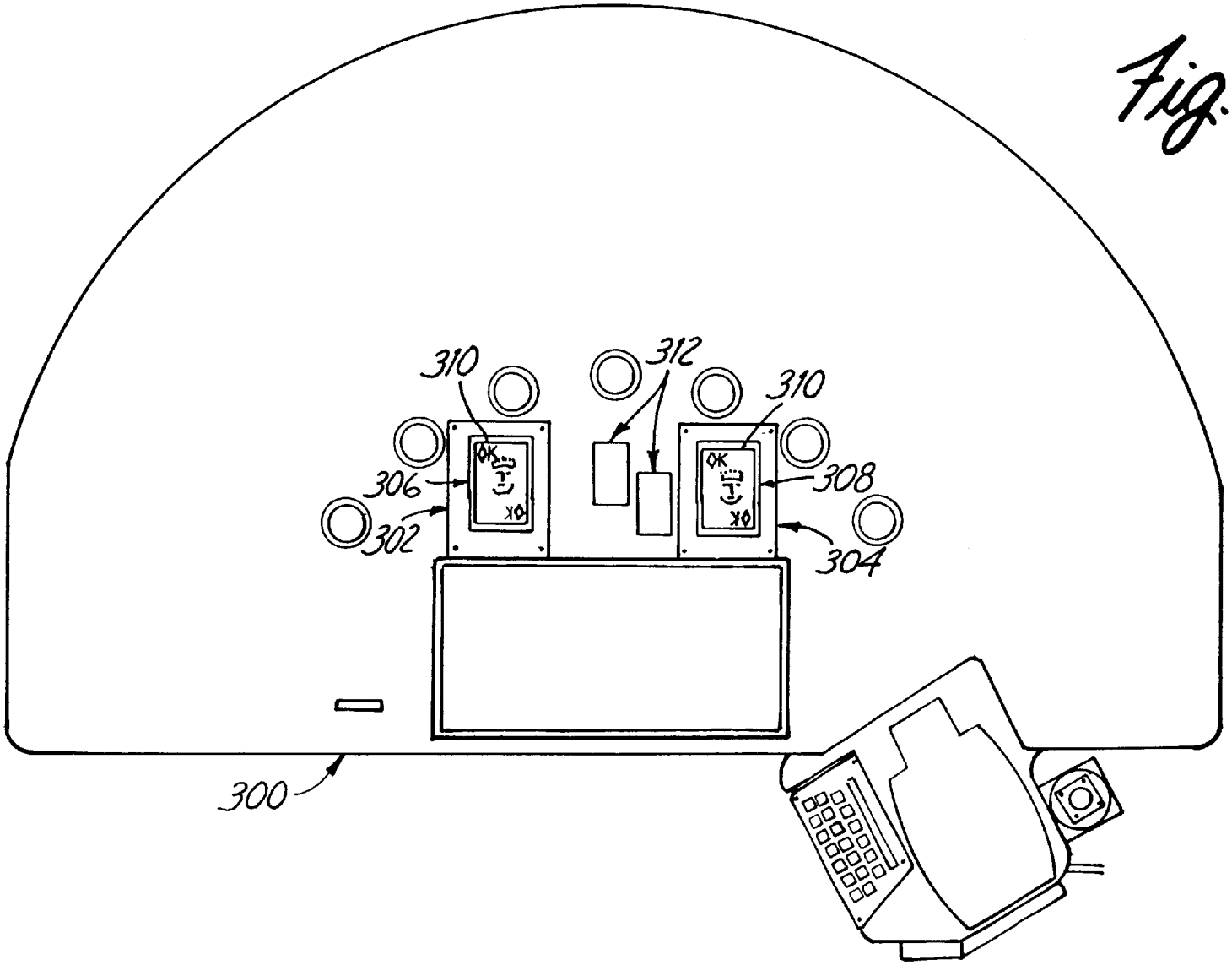
FIG. 3 is an overhead view of a second playing area of a card table with two video screen displays according to the invention.

Referring to FIG. 3, a gaming table 300 is provided. The gaming table is equipped with, for example, two video display units 302 and 304 which provide monitors 306 and 308 display a video representation of a common wild card 310 (here shown as the King of Diamonds) drawn from a separate virtual deck of cards. The second video display 308 is used to assure equal visibility of the wild card selected to each of the players. The monitor may be angled (not shown) towards the first base (first dealt) player and the third base (last dealt) player for easier viewing. FIG. 3 shows the use of a display of a wild card 310 that is both larger than the size of playing cards 312 used in the underlying game and having a pictorial representation on the face of the revealed wild card 310 that is different from the art work on the playing cards 312 used in the underlying play of the game. One or the other of the playing cards or the virtual cards may be a standard deck, with the difference provided as a security, promotional and/or entertainment feature. A game computer (not shown) is provided with memory and a central processing unit. The CPU is programmed to randomly select a card from the separate virtual deck for display on the monitors 302 and 304. The computer sends a signal to the video output displays, which in turn displays the wild card in display area 306 and 308.

In a draw poker game, the player may attempt to improve the ranking of the five-card hand by discarding up to five cards and replacing them with new cards randomly dealt from the master deck. At some time during the play of the game, herein for exemplary purposes only after the player rearranges the five-card hand, the solitary wild card 310 displayed on monitors 306 and 308 is turned face up or otherwise revealed and its face value determines the wild cards in this round of the game. That solitary card is provided preferably from a virtual shuffled deck that is distinct from the deck in which the cards used for the construction of a player's hand are chosen. The distinct deck may be a virtual deck (of one or more standard decks), an artificial deck (e.g., thirteen cards, one each of, 3, 4, 5, 6, 7, 8, 9, 10, Jack, Queen, King, and Ace), a special deck such as a Spanish 21 or pinochle deck or any other format of a virtual deck that will have one (or more) cards displayed on the video display screens in the area of the gaming table (e.g., near the table, on the edge of the table, displayed on a sign located in close proximity to the gaming table, or mounted on or in the gaming table). All cards in the five-card hand which have the same face value as the designated wild card 310 displayed in the monitors 306 and 308 are designated wild, i.e., they may possess any specified value which most improves the ranking of the five-card hand. If the five-card hand contains any wild cards, its ranking is reevaluated by the dealer and the player. The ranking of the five-card hand is then compared to the rankings of other players' hands in order to determine which player or players has won the wager.

Although the game has been described in the form of several specific embodiments, its arrangements and configurations are given only as examples, and many other variations of the game are possible. For example, in one version of the game only number cards, and not face cards such as Jacks, Queens, or Kings, may be allowed to be wild cards. Therefore, the scope of the invention should be determined, not by the examples given, but by the appended claims and their legal equivalents. For example, the card revelation system of the present invention could be practiced as part of a video gaming table, such as the device shown in Tarantino, U.S. Pat. No. 5,669,813, which displays virtual cards in the underlying game. The wild card can be displayed on the same video display or a different video display or on a sign near the table.

Some repeated mention has been made with regard to the flexibility allowed in the timing of the provision and/or display of the wild card. This action can of course significantly vary motivation to play a hand or alter a hand. For example, providing and displaying the wild card before the player discards can significantly change a player's strategy. For example, a player with a hand of ACE of Hearts, KING of Hearts, JACK of Hearts, TEN of Hearts and Three of diamonds would in all normal cases discard the Three of Diamonds. If the Wild Card were exposed prior to discarding and was a Three, the player would not discard a Three. Similarly, if a player's hand were ACE, KING, QUEEN of a single suit and a pair of deuces, most player's will discard the deuces to attempt to get either a Royal Flush, a Flush, a Straight or a pair higher than a pair of Jacks. If the Wild Card exposed before discarding were a two, playing strategy would be altered. More importantly, with a game such as Let It Ride® Stud Poker (registered trademark of Shuffle Master, Inc.), cards involved in the construction of the hand are displayed at different times in the play of the game. The significance of the time when the Wild Card is displayed therefore becomes much more influential on the play of the game and the strategy.

In the play of Let It Ride® Stud Poker (registered trademark of Shuffle Master, Inc.), the player is dealt three cards face down (which the player may view at any time) and the two common cards are dealt face down (which are initially withheld from view). A bet of equal value appears adjacent to each of the player's three cards. After viewing all three of the player's cards, the player may elect to withdraw the first of the three wagered tokens or allow all three wagers to continue in play, depending on the player's view of the likelihood of the three cards contributing to a winning hand (e.g., at least a pair of nine's). If the single displayed card that establishes the Wild Card were displayed before the election to retain or withdraw the first bet, the player would be in a much better position to establish the value of the hand. If the hand is a natural (e.g., with at least a pair of nine's), with or without a wild card, the player will always leave all bets on the table. If the player determines that at least one card is a wild card (one card in the player's hand matching the display card), the player is likely to remain in for all bets, even if no other card in the player's hand is at least a nine, as it is likely that at least one of the common cards will equal a nine or more or match one of the player's cards.

In Let It Ride® (registered trademark of Shuffle Master, Inc.) stud poker, it would also be advantageous to have the display card that determines the Wild Card turned face-up after the first election to retain or withdraw the first bet amount is made, but the influence is not quite as great. After the election to retain or withdraw has been made, and after at least one common card has been revealed the display card may then be revealed. This still improves the relative ability of a player to determine that there is a likelihood or assurance of a winning hand, but the impact is slightly lessened. That order of event is therefore also a likely scenario. The format that is most advantageous to the house is to reveal the display card only after both of the dealer's hole cards are revealed.

The wild card may be used in a wide variety of games as indicated herein. The wild card may also be used in games where payouts are determined by hand evaluations other than just ranks of hands, as in draw or stud poker games. For example, payouts may be determined on the basis of the value or numerical totals of hands, such as Blackjack, 7½ and 21½, Over/Under, and the like.

The method of the present invention is suitable for a wide variety of card games, including games in which players play against the dealer, (Caribbean Stud® poker, Pai Gow poker, Three Card poker™, and Blackjack), games in which the players compete against each other (i.e., poker), and for resolving side bet games (e.g., Pairs Plus bets in three card poker, the bonus bet in Let It Ride Bonus®, and a bonus bet in Caribbean Stud® poker). For a side bet game, the wild card can be used to score a base game, the side bet or both. When the method is used to score a side bet, the game can pay a proportional or progressive payout for combinations of the above.

What is claimed:

1. A method of playing a hybrid live casino card game with a video game component comprising:

a) randomly assigning a number of physical cards from a set of physical cards to a player, the player having made a wager on a game being played;

b) from a set of symbols that consists of a virtual set of symbols, randomly selecting and displaying at least one symbol that is a virtual display symbol identifying only a suit, only a rank, or both a suit and rank;

c) at any time during play of the game, revealing the virtual display symbol on a video monitor that is in the view of the player(s), the virtual display symbol establishing that cards from said first set of physical cards that bear a predetermined relationship to the virtual display symbol are Wild cards for the purpose of establishing a rank or value of the player's physical cards; and d) paying the player for:

II) attaining a rank of a game hand of at least a predetermined value; or

II) having a game card combination with a value higher than the value of a dealer's game cards combination; said player's game card combination being determined with or without the presence of Wild cards.

2. The method of claim 1 wherein a predetermined number of cards are assigned to a player as an original hand, and further comprising the steps of discarding cards from the original hand and dealing replacement cards, wherein step c) is performed before a player has elected to discard cards.

3. The method of claim 1 wherein a number of physical cards is assigned to a player as a hand, and wherein step c) is performed after a player has elected to exchange specific cards.

4. The method of claim 1 wherein a number of physical cards is assigned to a player as a hand, and wherein step c) is performed after a player has received replacement cards in exchange for discarded cards.

5. The method of claim 1 wherein the at least one virtual display symbol is displayed on a plurality of monitors.

6. The method of claim 1 wherein said virtual game symbol contains information with respect to only suit, only rank, both suit and rank, or the appearance of a card.

7. A method of playing a hybrid live casino card game with a video game component comprising:

a) dealing a number of physical cards from a first group of physical cards to a player to form an original hand in live casino table card game, the player having made a wager on the live casino table card game being played with that original hand;

b) from a separate virtual group of game symbols, displaying at least one game symbol that consists of a visual representation of a display card, suit, rank, or suit and rank on a video monitor that is in the view of the player(s);

c) at any time during play of the game, revealing the game symbol on a video monitor that is in the view of the player(s), the display card establishing that physical cards of predetermined relationship to the displayed game symbol are Wild Cards for the purpose of establishing a rank or value for the player's hand; and d) paying the player for:

I) attaining a hand of at least a predetermined rank; or

II) having a hand with a value higher than the value of a dealer's hand;

said rank or value being determined with or without the presence of Wild Cards.

8. A method of playing Let It Ride® poker according to claim 7 wherein the game symbol is a display card, said method comprising revealing a single common virtual display card to all players, wherein the single common virtual display card is not used as a card combined with players cards in play of the Let It Ride® poker, wherein ranked values of players' hands are read in view of the presence or absence of Wild Cards in individual hands based upon matching the display card.

9. The method of claim 7 wherein the wager is a multiple part wager comprising at least a first part and a second part, and step c) is performed after a player has made an election on retaining or withdrawing said first part of the wager.

10. The method of claim 9 wherein the wager is a multiple part wager comprising at least a first part, a second part, and a third part, and step c) is performed after a player has made an election on retaining or withdrawing said second part of the wager.

11. The method of claim 7 wherein the first group of cards is a standard deck of playing cards, wherein the standard deck of playing cards is used at a live casino table to deal the cards.

12. The method of claim 7 wherein the virtual display card displayed from the separate virtual deck has substantially different art work thereon than cards from the first group of cards used for the underlying live casino table game.

13. The method of claim 7 wherein said game comprises a casino card game that is selected from the group consisting of draw poker, stud poker, Caribbean Stud® poker, Texas Hold-Em poker, Blackjack, Pai Gow poker, Three Card Poker®, Baccarat, Mini Baccarat and Triple Play poker.

14. The method of claim 7 wherein the game of poker comprises Let It Ride® stud poker.

15. The method of claim 7 wherein the predetermined relationship is a) rank, b) suit or c) rank and suit.

16. The method of claim 7 wherein the step of revealing the value of the display card is performed after the player has received all cards for forming a final hand.

17. The method of claim 7 wherein a single card is displayed to determine a hand ranking for each player participating in a round of play.

18. A method of playing a hybrid live casino game of poker with a video component comprising:

a) dealing a number of physical playing cards to a player to form a first set of cards to form an original hand, the player having made a wager on a poker game being played with that original hand;

b) allowing the player to discard physical cards from the original hand;

c) dealing a player replacement cards from the first set of physical playing cards to bring the player's hand up to the number of cards used to play the game of poker;

d) from a separate deck of virtual playing symbols, displaying at least one virtual symbol that is a display symbol on a video monitor;

e) at any time during play of the game, revealing the value of each virtual display symbol, the virtual display symbol establishing a fact that cards of predetermined relationship to the virtual display symbol are Wild Cards for the purpose of establishing a poker rank for the player's hand; and f) paying the player for attaining a hand of at least a predetermined poker rank with or without the presence of Wild Cards.

19. The method of claim 18 wherein the first set of cards is a standard 52 card deck.

20. The method of claim 18 wherein the first set of cards comprises a plurality of standard 52 card decks, and the cards are randomly mixed within said plurality of standard 52 card decks.

21. The method of claim 20 wherein the step of showing the value of the display card is performed after the player has received all cards for forming a final hand.

22. The method of claim 18, wherein the game is played on a gaming table, and wherein the video monitor is mounted in the gaming table.

23. The method of claim 18 wherein the step of revealing the value of the display card is performed after the player has received all cards for a final hand.

24. A method of playing a game of poker comprising:

a) dealing a number of playing cards to a player from a first master set of physical cards to form at least one player's original hand, the player(s) having made a wager on a poker game being played with that original hand;

b) allowing the player to discard physical cards from the original hand;

c) dealing a player replacement cards from the first master set of physical cards to bring the player's hand up to the number of cards used to play the game of poker;

d) from a separate deck of virtual playing cards, dealing at least one virtual display card that is a display card displayed on a video monitor that is in the view of the player(s);

e) at any time during play of the game, revealing on the video monitor the value of the at least one virtual display card, the display card establishing that cards of equal rank to the display card are Wild Cards for the purpose of establishing a rank for the player's hand; and f) paying the player for attaining a hand of at least a predetermined rank with or without the presence of Wild Cards.

25. The method of claim 24 wherein each card in the hand defines a card position, and wherein the master set of cards comprises one or more special decks of cards, either segregated by card position or intermixed.

26. The method of claim 24 wherein said second master set comprises a standard 52 card deck.

27. The method of claim 24 wherein said poker game comprises draw poker.

28. The method of claim 24 wherein said virtual game symbol contains information with respect to only suit, only rank, both suit and rank, or the appearance of a card.

29. method of playing a hybrid live casino game with a video game component comprising:

a) dealing a number of physical symbols to a player to form an original hand, the player having made a wager on a game to be played with that original hand;

b) from a separate virtual set of symbols, selecting at least one symbol that is a display symbol;

c) at any time during play of the game, revealing the display symbol on a video monitor that is in the view of the player(s), the display symbol establishing that symbols of predetermined relationship to the display symbol are Wild symbols for the purpose of establishing a rank or value for the player's hand; and d) paying the player for:

I) attaining a hand of at least a predetermined rank; or

II) having a hand with a value higher than the value of a dealer's hand;

said rank or value being determined with or without the presence of Wild symbols.

30. The method of claim 29 wherein the selection of the at least one symbol is randomly determined.

* * * * *